US005930995A

United States Patent [19]

Watanabe et al.

[11] Patent Number: 5,930,995

[45] Date of Patent: Aug. 3, 1999

[54] EXHAUST GAS PURIFICATION DEVICE FOR A COMPRESSION-IGNITION COMBUSTION ENGINE

[75] Inventors: Yoshimasa Watanabe, Sunto-gun; Yasushi Araki, Susono; Kiyoshi Kobashi, Mishima; Yoshimitu Henda, Numazu, all of Japan

[73] Assignee: Toyota Jidosha Kabushiki Kaisha, Aichi, Japan

[21] Appl. No.: 08/906,801

[22] Filed: Aug. 6, 1997

[30] Foreign Application Priority Data

Aug. 9, 1996 [JP] Japan ..... 8-211386

[51] Int. Cl.[6] ..... F01N 3/00

[52] U.S. Cl. ..... 60/311; 60/296; 55/DIG. 30

[58] Field of Search ..... 60/287, 288, 291, 60/295, 311, 302, 296; 55/DIG. 30

[56] References Cited

U.S. PATENT DOCUMENTS 2,706,012 4/1955 Chipley ..... 60/311
4,663,934 5/1987 Sickels ..... 60/302
4,709,547 12/1987 Pischinger et al. ..... 60/311
4,887,427 12/1989 Shinzawa et al. .
5,171,337 12/1992 Pollock ..... 60/311

FOREIGN PATENT DOCUMENTS 0 260 031 3/1988 European Pat. Off. .
5-69311 U 9/1993 Japan .

*Primary Examiner*—Thomas E. Denion
*Attorney, Agent, or Firm*—Oliff & Berridge, PLC

[57] ABSTRACT

An exhaust gas purification device of a compression-ignition combustion engine comprises exhaust branch passages each being connected to a corresponding cylinder of the engine at one end thereof and connected to a common exhaust passage at the other end thereof, and a filter arranged in at least one of the exhaust branch passages to trap particulates in the exhaust gas discharged from the engine. Pressure in the exhaust branch passage upstream of the filter is controlled to continuously make the pressure equal to or greater than a pressure in the exhaust branch passage downstream of the filter.

18 Claims, 9 Drawing Sheets

EXHAUST GAS PURIFICATION DEVICE FOR A COMPRESSION-IGNITION COMBUSTION ENGINE

BACKGROUND OF THE INVENTION

1. Field of the Invention

The invention relates to an exhaust gas purification device for a compression-ignition combustion engine.

2. Description of the Related Art

An exhaust gas discharged from a compression-ignition combustion engine includes carbon particulates. The particulates discharged to the outside air may lead to environmental pollution.

Japanese unexamined patent publication (Kokai) No. 5-69311 discloses an exhaust gas purification device of a compression-ignition combustion engine, comprising exhaust branch passages each being connected to a corresponding cylinder of the engine at one end thereof and connected to a common exhaust passage at the other end thereof, and filters arranged in the exhaust branch passages to trap the carbon particulates, respectively.

At the first stage of trapping the carbon particulates, first thin carbon particulate layers are formed in the filters when the exhaust gas discharged from the engine flows into the filters. At the second stage of trapping the carbon particulates, the filters trap much particulates since the first carbon particulate layers facilitate trapping of the carbon particulates.

By the way, in a four-cylinder engine, an exhaust cycle in each cylinder is sequentially performed at every crank angle of 180° (referring to FIG. 10). Therefore, when one of the cylinders is in the exhaust cycle, other cylinders are not in the exhaust cycle. As the exhaust gas discharged from the one cylinder flows into the exhaust passage of the exhaust manifold, the pressure the level in the common exhaust passage increases to a pressure level which is greater than atmospheric pressure. On the other hand, the pressure levels in the exhaust branch passages upstream of the corresponding filters, which passages are connected to the cylinders which are not in the exhaust cycle, are generally at atmospheric pressure.

Therefore, the exhaust gas discharged from the one cylinder flows back into the filters arranged in the exhaust branch passages which are connected to the cylinders which are not in the exhaust cycle. Due to the flow back of the exhaust gas into the filters, the first carbon particulate layers are removed from the filters. Thus, the capability of the filters for trapping the carbon particulates decreases.

SUMMARY OF THE INVENTION

Accordingly, the object of the invention is to prevent the flow back of the exhaust gas into the filters in an exhaust gas purification device of a compression-ignition combustion engine.

According to the present invention, there is provided an exhaust gas purification device of a compression-ignition combustion engine, the device comprising: exhaust branch passages each being connected to a corresponding cylinder of the engine at one end thereof and connected to a common exhaust passage at the other end thereof; a filter arranged in at least one of the exhaust branch passages to trap particulates in the exhaust gas discharged from the engine; and pressure control means for controlling a pressure in the exhaust branch passage upstream of the filter to continuously make the pressure equal to or greater than a pressure in the exhaust branch passage downstream of the filter.

Further, according to the present invention, the pressure control means comprises a communication passage which communicates the exhaust branch passage upstream of the filter with another exhaust branch passage.

Further, according to the present invention, a length of the exhaust branch passage downstream of the filter is longer than a length of the exhaust branch passage upstream of the filter to continuously make the pressure in the exhaust branch passage upstream of the filter equal to or greater than a pressure in the exhaust branch passage downstream of the filter.

Further, according to the present invention, a pressure increasing means is provided for increasing a pressure of the exhaust branch passage downstream of the filter to a pressure level which is sufficiently high for the exhaust gas to flow back from the exhaust branch passage downstream of the filter to the exhaust branch passage upstream of the filter.

Further, according to the present invention the pressure increasing means comprises a valve arranged in the common exhaust passage.

Further, according to the present invention, the valve is normally open and is closed when the pressure in the exhaust branch passage downstream of the filter is to be greater than the pressure in the exhaust branch passage upstream of the filter.

Further, according to the present invention, the pressure control means comprises a communication passage which communicates the exhaust branch passage upstream of the filter with another exhaust branch passage, and the pressure increasing means comprises a valve arranged in the communication passage.

Further, according to the present invention, the valve is normally open and is closed when the pressure in the exhaust branch passage downstream of the filter is to be greater than the pressure in the exhaust branch passage upstream of the filter.

Further, according to the present invention, the pressure increasing means comprises a communication passage which communicates the exhaust branch passage downstream of the filter with another exhaust branch passage, and a valve arranged in the communication passage.

Further, according to the present invention, the valve is normally closed and is opened when the pressure in the exhaust branch passage downstream of the filter is to be greater than the pressure in the exhaust branch passage upstream of the filter.

Further, according to the present invention, a turbine wheel of a turbo-changer is arranged in the common exhaust passage.

Further, according to the present invention, a portion of the exhaust branch passage extends generally vertically, and the filter is arranged in the vertically extending portion.

The present invention may be more fully understood from the description of the preferred embodiments of the invention set forth below, together with the accompanying drawings.

DESCRIPTION OF THE PREFERRED EMBODIMENTS

Figure 1:
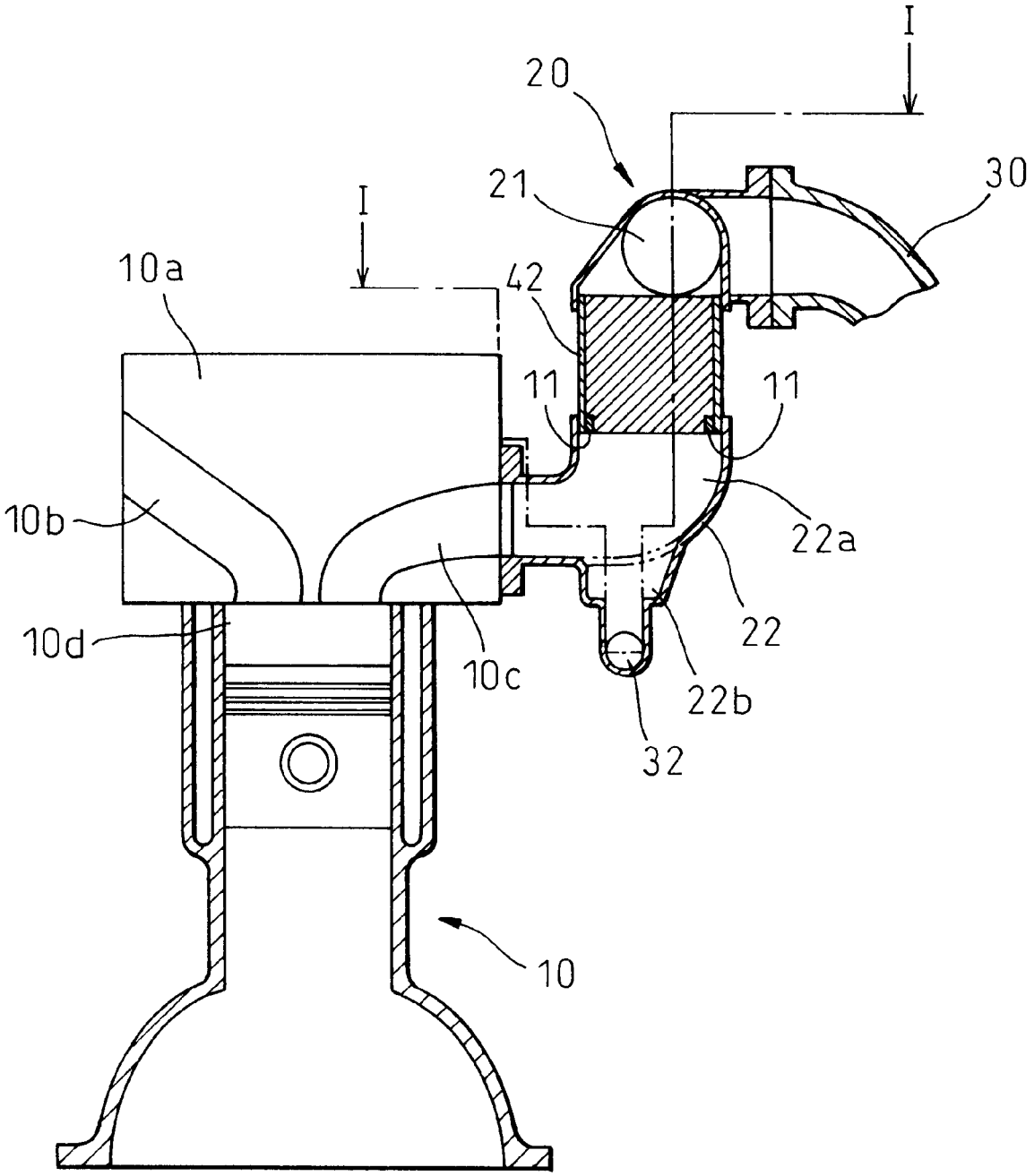
FIG. 1 is a cross sectional view of an exhaust gas purification device of a compression-ignition combustion engine according to the first embodiment of the invention.

Referring to FIG. 1, reference number 10 is a compression-ignition combustion engine. The engine 10 has four cylinders 10*d* and a cylinder head 10*a*. In the first embodiment, an exhaust cycle of each cylinder of the engine is sequentially performed at the first cylinder, the third cylinder, the fourth cylinder and the second cylinder. The cylinder head 10*a* has four intake ports 10*b* and four exhaust ports 10*c*. Each intake port 10*b* is connected to a corresponding cylinder 10*d* while each exhaust port 10*c* is connected to a corresponding cylinder 10*d*.

An exhaust manifold 20 is connected to the cylinder head 10*a* of the engine 10. The exhaust manifold 20 has four exhaust branch passages 22, 23, 24 and 25 and a common exhaust passage 21. Each exhaust branch passage 22–25 is connected to the corresponding cylinder 10*d* via the corresponding exhaust port 10*c* at one end thereof. Further, the exhaust branch passages 22–25 are connected to the common exhaust passage 21 at other ends thereof. The common exhaust passage 21 is connected to an exhaust pipe 30 which extends to the outside air.

The exhaust branch passages 22–25 extend generally horizontally from the cylinder head 10*a*, and then extend generally vertically to the common exhaust passage 21. Therefore, a portion of each exhaust branch passage extends generally vertically.

Each filter 42–45 is arranged in the vertically extending portion of each exhaust branch passage 22–25. The filters 42–45 are known in the art. Each filter 42–45 has filtering passages therein defined by porous permeable filtering walls. The filtering passages extend along the flowing direction of the exhaust gas. Using ceramic closures, some filtering passages are closed at upstream-side open ends thereof and remaining filtering passages adjacent to the filtering passages which are closed at the upstream-side open ends are closed at downstream-side open ends thereof. Therefore, the exhaust gas flows through the filtering walls. The filtering walls trap carbon particulates in the exhaust gas discharged from the engine 10 when the exhaust gas flows through the filtering walls.

Note that the words "upstream" and "downstream" are related to the flow direction of the exhaust gas flowing from the cylinder to the outside air.

An electric heater 11 is arranged in each filter 42–45. The heater 11 is operated to burn the carbon particulates trapped in the filter at a predetermined time interval in order to prevent an increase in the resistance of the filter to the exhaust gas flow. Due to the burning of the carbon particulates, burnable ingredients of the carbon particulates stacked on the filter can be removed from the filter.

Note that, in addition to or instead of the heater 11, other means for burning carbon particulates, such as means for supplying the filter with fuel and air may be used.

Figure 2:
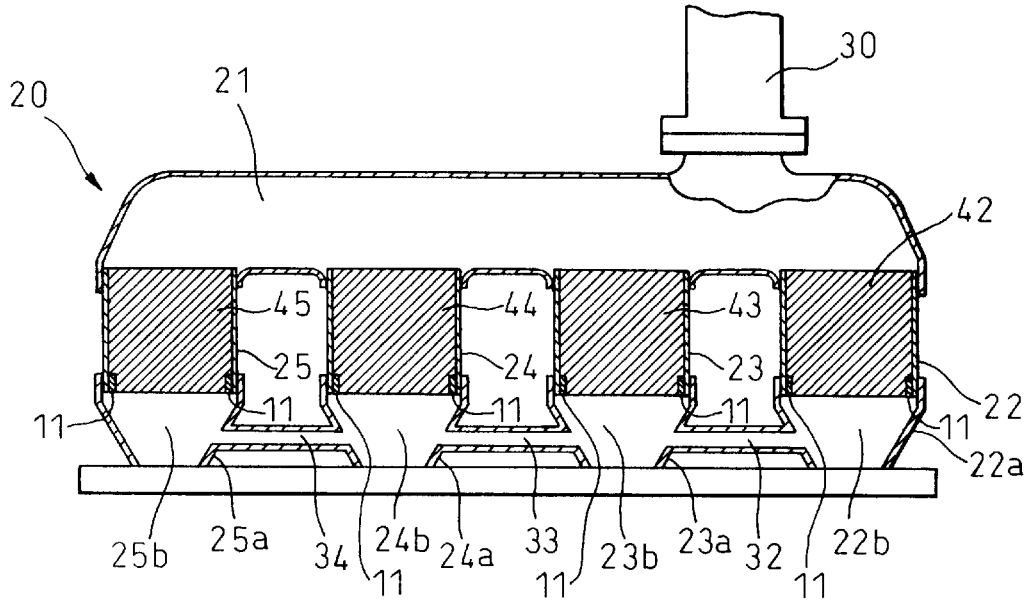
FIG. 2 is a cross sectional view along line I—I in FIG. 1.

Referring to FIG. 2, the first exhaust branch passage 22 upstream of the filter 42 is connected to the second exhaust branch passage 23 upstream of the filter 43 via a communication passage 32. The second exhaust branch passage 23 upstream of the filter 43 is connected to the third exhaust branch passage 24 upstream of the filter 44 via a communication passage 33. The third exhaust branch passage 24 upstream of the filter 44 is connected to the fourth exhaust branch passage 25 upstream of the filter 45 via a communication passage 34.

When the exhaust gas is discharged from the first cylinder in the exhaust cycle, the pressure level in the first exhaust branch passage 22 upstream of the filter 42 increases. Since the other cylinders are not in the exhaust cycle, the exhaust gas in the first exhaust branch passage 22 upstream of the filter 42 flows into the other exhaust branch passages 23–25 upstream of the filters 43–45 via the communication passages 32–34. Therefore, the pressure level in the exhaust branch passages 22–25 upstream of the filters 42–45 become generally equal to each other.

The exhaust gas in the exhaust branch passages 22–25 flows through the corresponding filters 42–45 to the common exhaust passage 21. The pressure level in the common exhaust passage 21 is lower than the pressure level in the exhaust branch passages 22–25 upstream of the filters 42–45 since the filters 42–45 function as a resistance to the exhaust gas flow.

Figure 3:
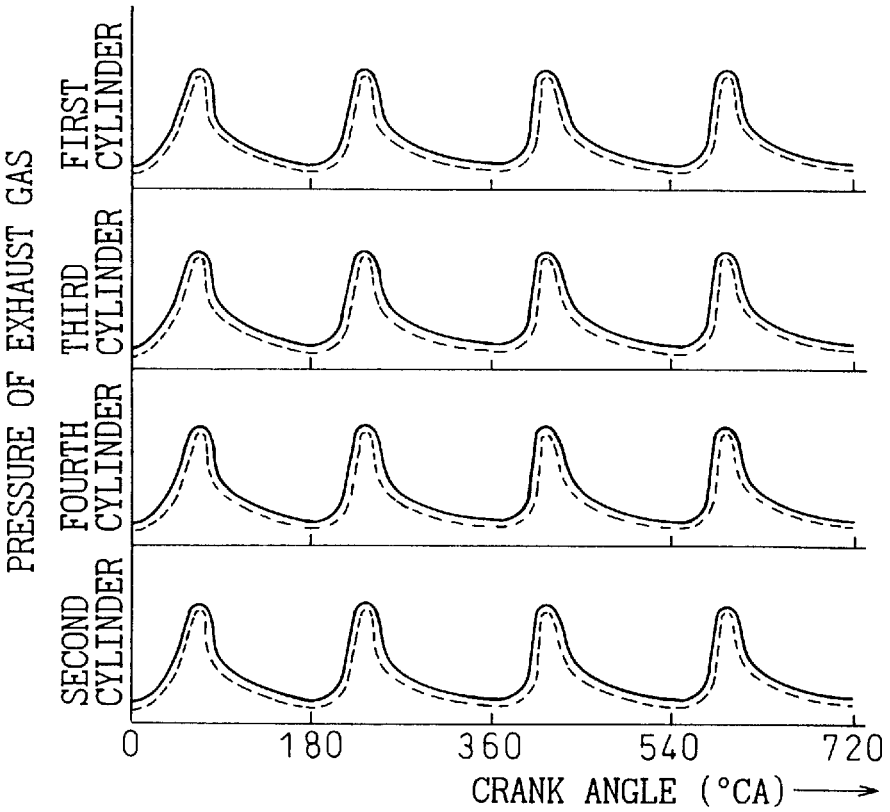
FIG. 3 is a view illustrating a relationship between a crank angle and an exhaust pressure in the exhaust gas purification device according to the first embodiment of the invention.

The pressure level in each exhaust branch passage 22–25 upstream of the corresponding filter 42–45 and the pressure level in a portion of the common exhaust passage 21 adjacent to the corresponding filter 42–45 is changed as in FIG. 3. Note that, in FIG. 3, the solid lines show the change of the pressure in each exhaust branch passages 22–25 upstream of the corresponding filters 42–45, and the dotted lines show the change of the pressure in the portions of the common exhaust passage 21 adjacent to the corresponding filters 42–45.

Therefore, according to the first embodiment, the exhaust gas in the common exhaust passage 21 does not flow back from the common exhaust passage 21 into the filters 42–45. Thus, the first carbon particulate layers formed on the filtering walls are not removed from the filtering walls of the filter 42–45.

In the first embodiment, the filters 42–45 are arranged close to the engine. Thus, the hot exhaust gas flows into the filters 42–45. The carbon particulates trapped on the filtering walls are burned by the hot exhaust gas. Therefore, the heating means such as the heater 11 may be eliminated.

Note that, in the first embodiment, the communication passages function as pressure control means for controlling a pressure in the exhaust branch passage upstream of the corresponding filter to continuously make the pressure equal to or greater than the pressure in the common exhaust passage, the common exhaust passage and/or the exhaust pipe correspond to the exhaust branch passage downstream of the filter, and the communication passage communicates an exhaust branch passage upstream of the filter with other exhaust branch passage upstream of the filter.

In the compression-ignition combustion engine, an engine oil entering into the cylinders 10*d* may be burned in the cylinders 10*d*. The engine oil includes calcium and phosphorus. Therefore, calcium or phosphorous oxide or sulfide is produced when the engine oil is burned. The calcium or phosphorus oxide or sulfide is trapped on the filtering walls.

On burning the carbon particulates including the calcium or phosphorus oxide or sulfide trapped on the filtering walls, the calcium or phosphorus oxide or sulfide can hardly be burned. The calcium or phosphorus oxide or sulfide remaining on the filtering walls decreases permeability of the filtering walls. Therefore, it is necessary to remove the calcium or phosphorus oxide or sulfide from the filtering walls.

According to the second embodiment, the calcium or phosphorus oxide or sulfide can be removed from the filtering walls.

Figure 4:
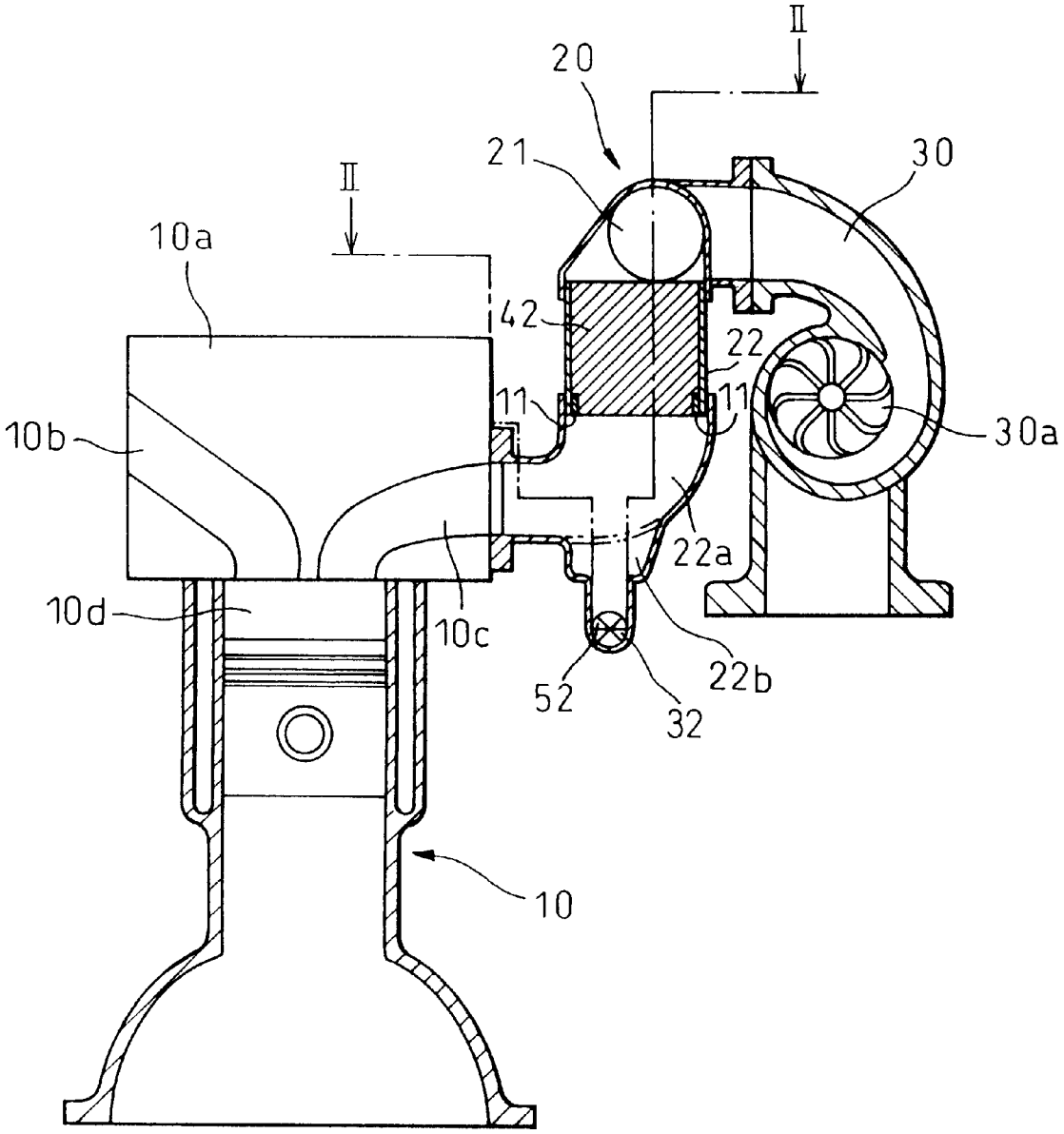
FIG. 4 is a cross sectional view of an exhaust gas purification device of a compression-ignition combustion engine according to the second embodiment of the invention.
Figure 5:
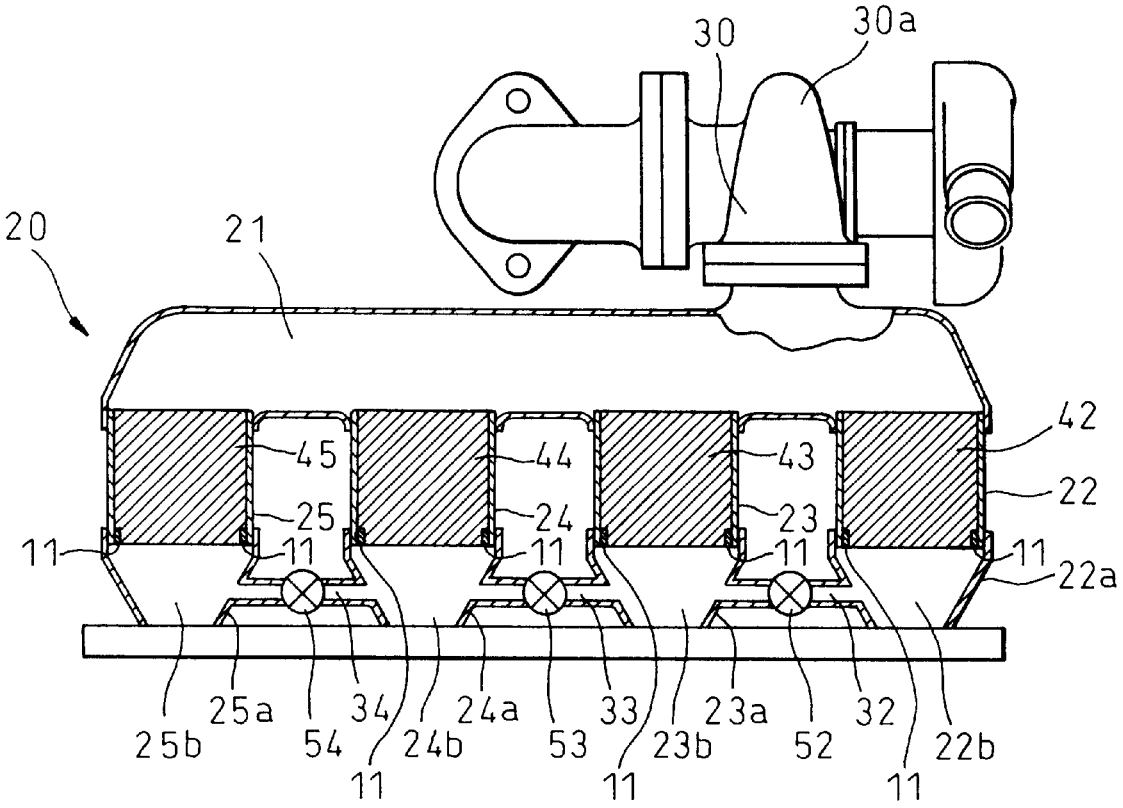
FIG. 5 is a cross sectional view along line II—II in FIG. 4.

Referring to FIGS. 4 and 5, an exhaust gas purification device of a compression-ignition combustion engine according to the second embodiment of the invention is shown. A turbine wheel 30*a* of a turbo-charger is arranged in the exhaust pipe 30.

Valves 52–54 are arranged in the communication passages 32–34, respectively. The valves 52–54 are opened when the pressure level in the common exhaust passage 21 is to be equal to or lower than the pressure level in the exhaust branch passages 22–25 upstream of the corresponding filters 42–45. Therefore, the exhaust gas flows from upstream of the filters 42–45 to downstream of the filters 42–45. The carbon particulates including the calcium or phosphorus oxide or sulfide are trapped on the filtering walls.

On the other hand, the valves 52–54 are closed when the pressure level in the common exhaust passage 21 is to be greater than the pressure level in the exhaust branch passages 22–25 upstream of the corresponding filters 42–45 after the carbon particulates trapped on the filtering walls are burned by the heating means such as the electric heater 11. Therefore, the exhaust gas flows back from downstream of the filters 42–45 to upstream of the filters 42–45 in the exhaust branch passages 22–25 which are not in the exhaust cycle. Thus, the calcium or phosphorus oxide or sulfide is removed from the filtering walls.

Further, the filters 42–45 are arranged in the vertically extending portions of the corresponding exhaust branch passages 22–25, respectively. Spaces 22*b*–25*b* are formed in the corresponding exhaust branch passages 22–25 beneath the filters 42–45. Therefore, the force of gravity allows the calcium or phosphorus oxide or sulfide to be easily removed downwardly and stacked in the spaces 22*b*–25*b* formed in the corresponding exhaust branch passages 22–25.

Further, since the turbine wheel 30*a* is a resistance to the exhaust gas, the turbine wheel 30*a* allows the pressure level in the common exhaust passage 21 to be greater than the pressure level in the exhaust branch passages 22–25.

The spaces 22*b*–25*b* are protrude from corresponding bottom walls of the exhaust branch passages 22–25 upstream of the filters 42–45. Therefore, the exhaust gas cannot introduce the calcium or phosphorus oxide or sulfide stacked in the spaces 22*b*–25*b* to the filters 42–45.

Figure 6:
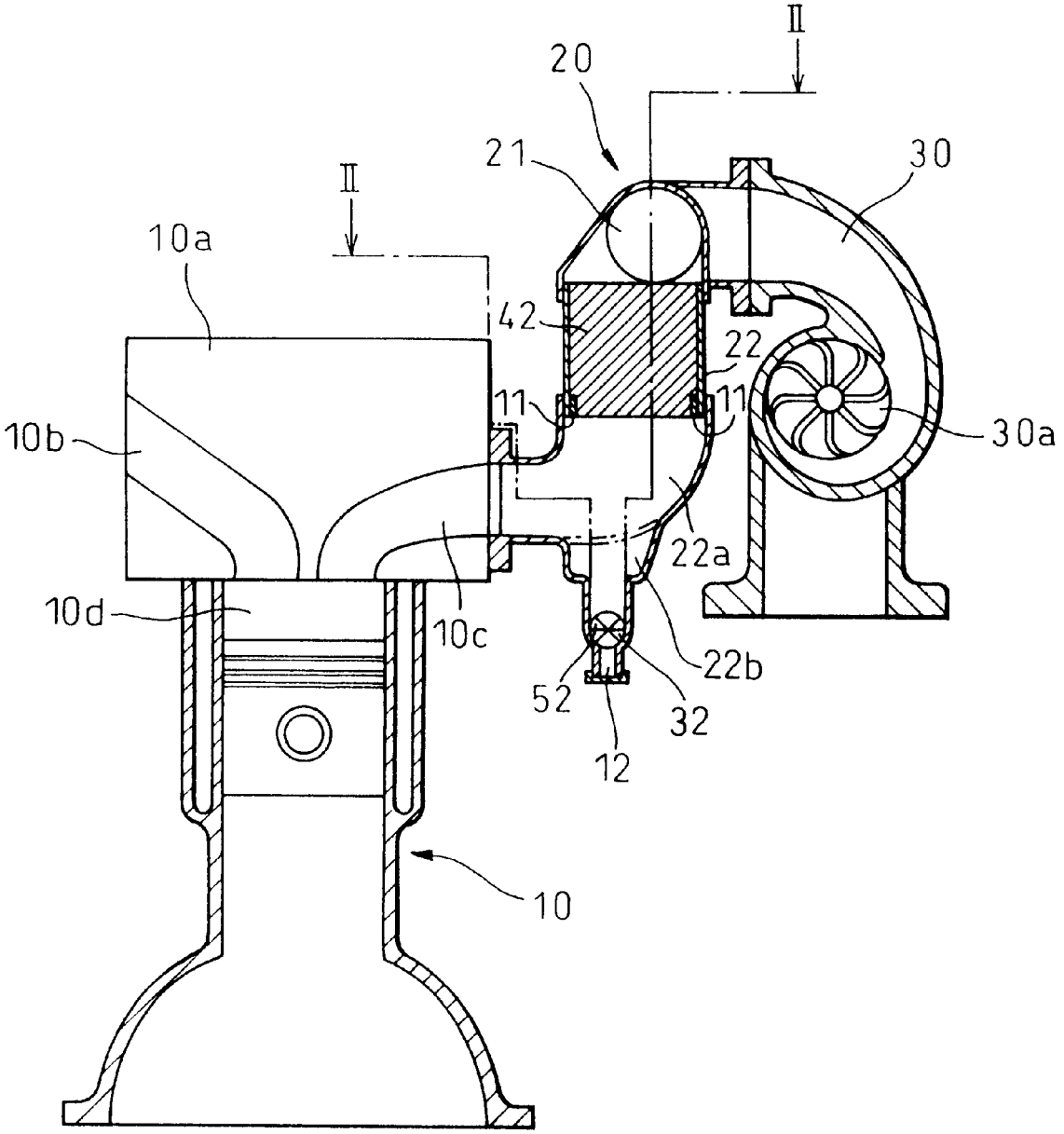
FIG. 6 is a cross sectional view of the modified embodiment of the second embodiment.

As shown in FIG. 6, openings 12 may be formed in walls defining the spaces 22*b*–25*b*, respectively, and the calcium or phosphorus oxide or sulfide may be taken out through the openings 12 to the outside of the spaces 22*b*–25*b*.

Figure 7:
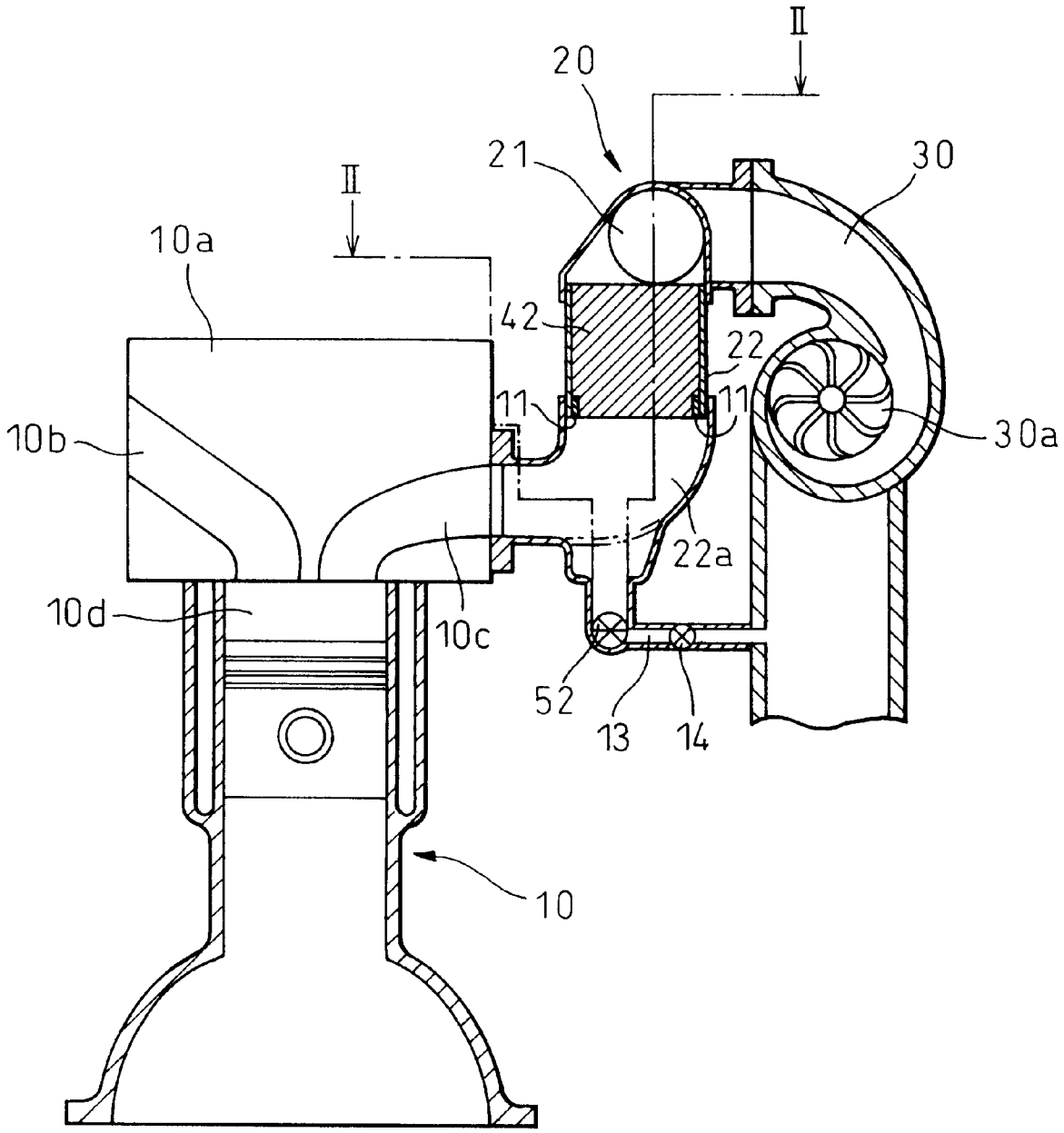
FIG. 7 is a cross sectional view of the other modified embodiment of the second embodiment.

As shown in FIG. 7, each exhaust branch passage 22–25 upstream of the corresponding filter 42–45 may be connected to the exhaust pipe 30 via bypass passages 13 in which valves 14 are arranged. When the valve 14 is opened, the calcium or phosphorus oxide or sulfide flows through the bypass passage 13 to the exhaust pipe 30 by the exhaust gas. Therefore, the calcium or phosphorus oxide or sulfide is removed from the spaces 22*b*–25*b*.

In the second embodiment, the filters 42–45 are located adjacent to the common exhaust passage 21. The flow distance for the exhaust gas which flows through each filter and flows back into the other filter is shorter. Therefore, the capability of removing the calcium or phosphorus oxide or sulfide from the filter increases since the pressure level of the exhaust gas flowing back into the filter is higher due to the short flow distance for the exhaust gas.

Note that, in the second embodiment, the communication passages function as pressure control means for controlling a pressure in the exhaust branch passage upstream of the corresponding filter to continuously make the pressure equal to or greater than the pressure in the common exhaust passage, the valves function as pressure increasing means for increasing a pressure of the exhaust branch passage downstream of the filter to a pressure level which is sufficiently high for the exhaust gas to flow back from the exhaust branch passage downstream of the filter to the exhaust branch passage upstream of the filter, the common exhaust passage and/or the exhaust pipe correspond to the exhaust branch passage downstream of the filter, and the communication passage communicates an exhaust branch passage upstream of the filter with other exhaust branch passages upstream of the filter.

Also, note that the structure of the second embodiment except for the above-described structure of the second embodiment is the same as the first embodiment.

Figure 8:
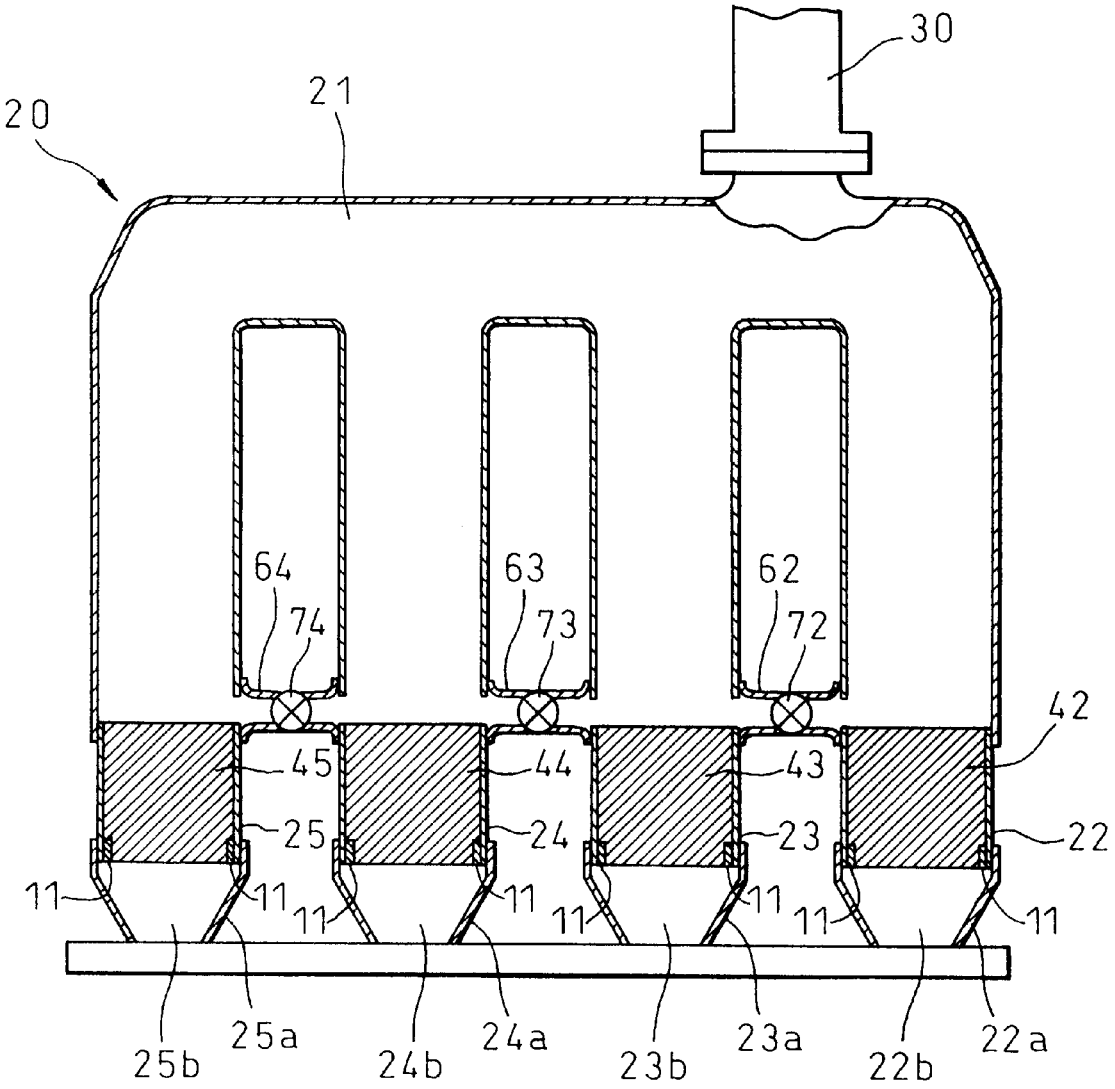
FIG. 8 is a cross sectional view of an exhaust gas purification device of a compression-ignition combustion engine according to the third embodiment of the invention, similar to FIG. 2.

Referring to FIG. 8, an exhaust gas purification device according to the third embodiment is shown. In the third embodiment, the exhaust branch passages 22–25 downstream of the filters 42–45 are longer than the exhaust branch passages 22–25 upstream of the filters 42–45.

The first exhaust branch passage 22 downstream of the filter 42 is connected to the second exhaust branch passage 23 downstream of the filter 43 via a communication passage 62. The second exhaust branch passage 23 downstream of the filter 43 is connected to the third exhaust branch passage 24 downstream of the filter 44 via a communication passage 63. The third exhaust branch passage 24 downstream of the filter 44 is connected to the fourth exhaust branch passage 25 downstream of the filter 45 via a communication passage 64.

Valves 72–74 are arranged in the communication passages 62–64, respectively. The valves 72–74 are closed when the pressure level in the common exhaust passage 21 is to be equal to or lower than the pressure level in the exhaust branch passages 22–25 upstream of the corresponding filters 42–45. Since the exhaust branch passages 22–25 downstream of the filters 42–45 are longer than the exhaust branch passages 22–25 upstream of the filters 42–45, the pressure level of the exhaust gas flowing through the corresponding filter 42–45 decreases at the common exhaust passage 21. Therefore, the exhaust gas does not flow back from downstream of the filter 42–45 to upstream of the filter 42–45. The carbon particulates including calcium or phosphorus oxide or sulfide are trapped on the filtering walls.

On the other hand, the valves 72–74 are opened when the pressure level in the common exhaust passage 21 is to be greater than the pressure level in the exhaust branch passages 22–25 upstream of the corresponding filters 42–45 after the carbon particulates trapped on the filtering walls are burned by the heating means. The exhaust gas discharged from the cylinder 10*d* flows through the communication passage 62–64 and flows back from downstream of the filter 42–45 to upstream of the filter 42–45 in the exhaust branch passage 22–25 which is not in the exhaust cycle. Thus, the calcium or phosphorus oxide or sulfide is removed from the filtering walls.

Note that, in the third embodiment, the long exhaust branch passages downstream of the filters function as pressure control means for controlling a pressure in the exhaust branch passage upstream of the filter to continuously make the pressure equal to or greater than the pressure in the common exhaust passage, and the communication passages and the valves arranged therein function as pressure increasing means for increasing a pressure of the exhaust branch passage downstream of the filter to a pressure level which is sufficiently high for the exhaust gas to flow back from the exhaust branch passage downstream of the filter to the exhaust branch passage upstream of the filter.

Also, note that the structure of the third embodiment except for the above-described structure of the third embodiment is the same as the first embodiment.

The pulse of the exhaust gas discharged from a cylinder may add to the pulse of the exhaust gas discharged from one of other cylinders, depending on length and cross sectional area of the exhaust branch passages downstream of the filters. When the pulse of the exhaust gas discharged from a cylinder adds to the pulse of the exhaust gas discharged from one of the other cylinders, the pressure in the exhaust branch passages connected to the other cylinders becomes higher. Therefore, if the length and the cross sectional area are selected so that the pulse of the exhaust gas transferred from a cylinder adds to the pulse of the exhaust gas discharged from one of the other cylinders when the valves 72–74 are closed, the valves 72–74 may be normally open and may be closed when the pulse of the exhaust gas transferred from a cylinder is to be added to the pulse of the exhaust gas discharged from the cylinder.

Thus, the calcium or phosphorus or sulfide trapped on the filtering walls of the filter arranged in the exhaust branch passage connected to one of the other cylinders is removed.

Figure 9:
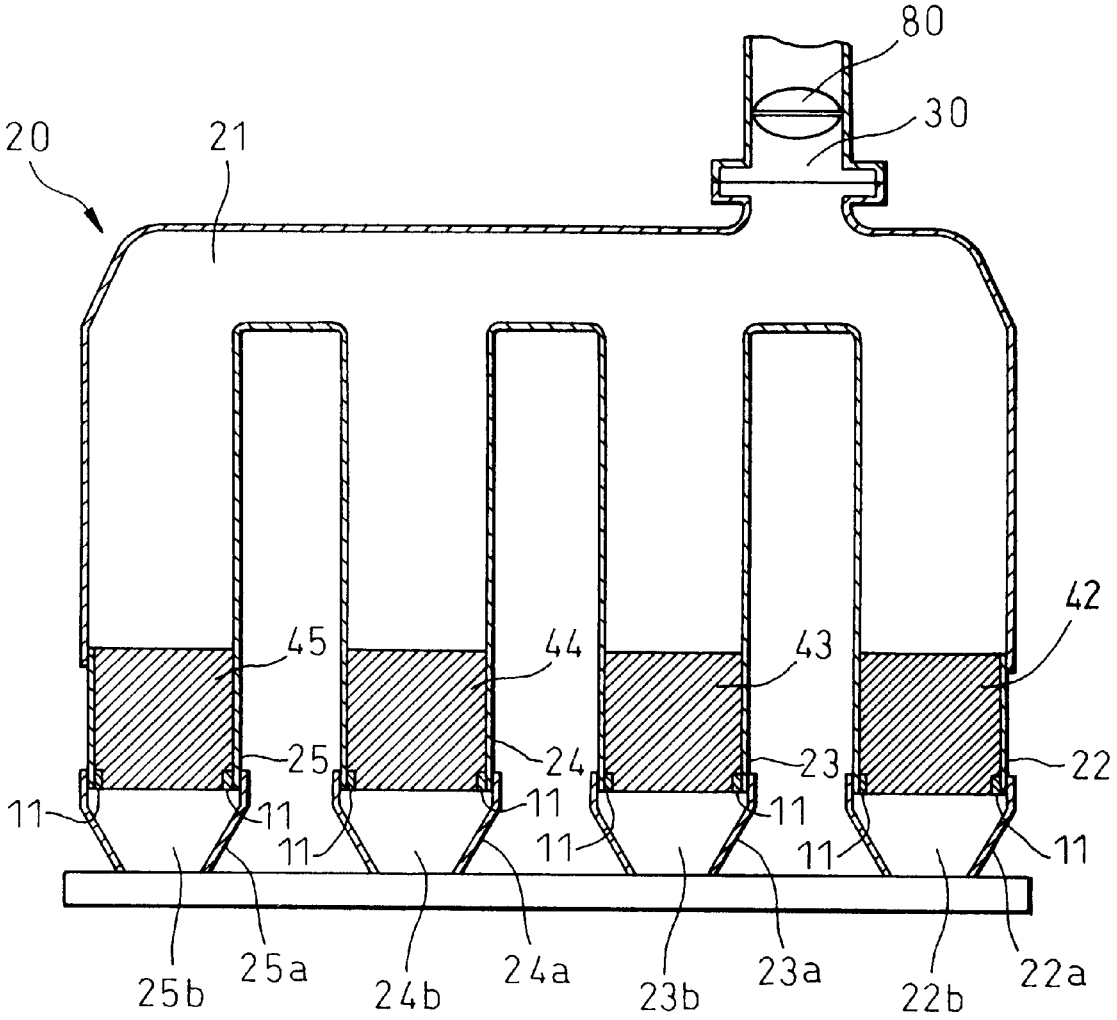
FIG. 9 is a cross sectional view of an exhaust gas purification device of a compression-ignition combustion engine according to the fourth embodiment of the invention, similar to FIG. 2.
Figure 10:
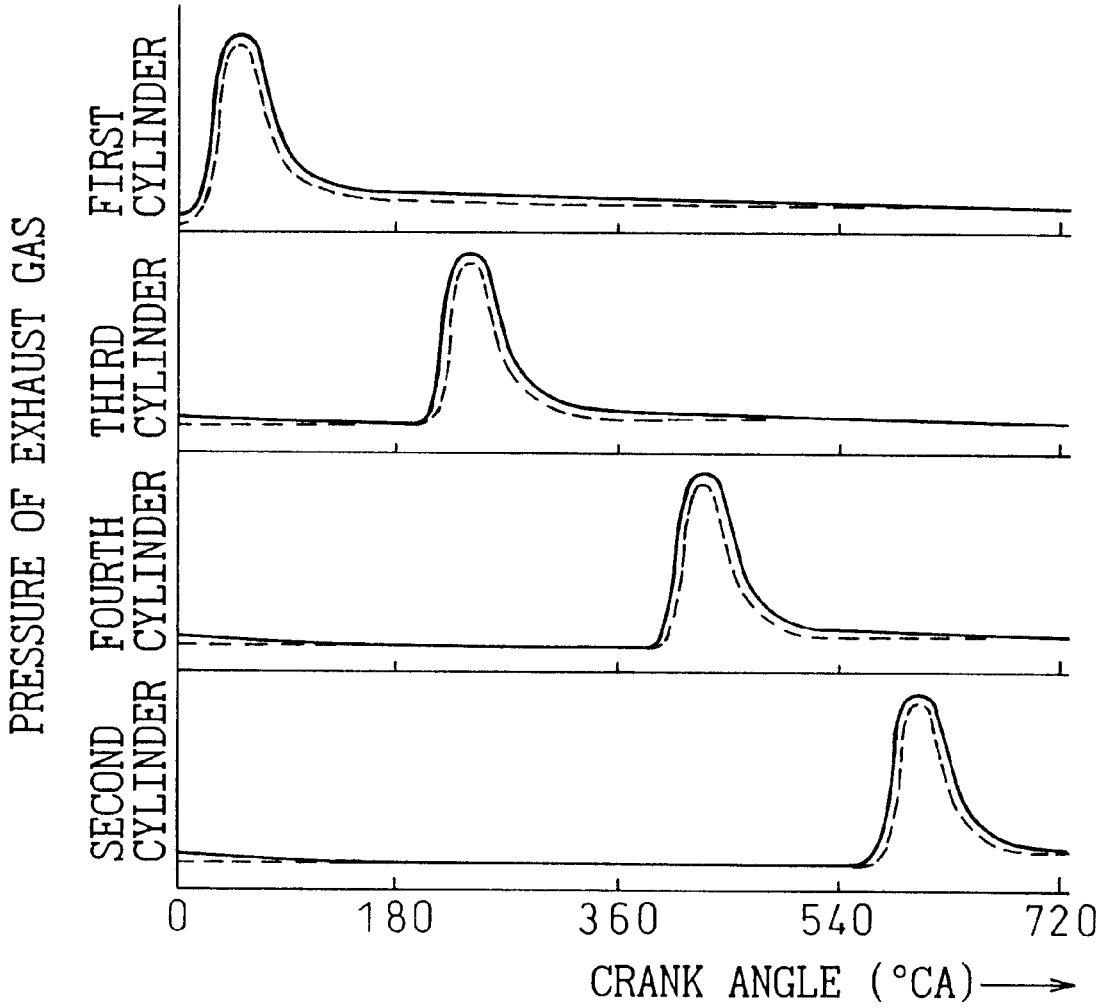
FIG. 10 is a view illustrating a relationship between a crank angle and an exhaust pressure in the exhaust gas purification device according to the prior art.

Referring to FIG. 9, an exhaust gas purification device according to the fourth embodiment is shown. In the fourth embodiment, the exhaust branch passages 22–25 downstream of the filters 42–45 are longer than the exhaust branch passages 22–25 upstream of the filters 42–45.

A valve 80 is arranged in the exhaust pipe 30. The valve 80 is opened when the pressure level in the common exhaust passage 21 is to be equal to or lower than the pressure level in the exhaust branch passages 22–25 upstream of the corresponding filters 42–45. Since the exhaust branch passages 22–25 downstream of the filters 42–45 are longer than the exhaust branch passages 22–25 upstream of the filters 42–45, the pressure level of the exhaust gas flowing through the corresponding filter 42–45 decreases at the common exhaust passage 21. Therefore, the exhaust gas does not flow back from downstream of the filter 42–45 to upstream of the filter 42–45. The carbon particulates including calcium or phosphorus oxide or sulfide are trapped on the filtering walls.

On the other hand, the valve 80 is closed when the pressure level in the common exhaust passage 21 is to be greater than the pressure level in the exhaust branch passages 22–25 upstream of the corresponding filters 42–45 after the carbon particulates trapped on the filtering walls are burned by the heating means. The exhaust gas discharged from the cylinder 10*d* flows back from downstream of the filer 42–45 to upstream of the filter 42–45 in the exhaust branch passage 22–25 which is not in the exhaust cycle. Thus, the calcium or phosphorus oxide or sulfide is removed from the filtering walls.

Note that, in the fourth embodiment, the long exhaust branch passages downstream of the filters function as pressure control means for controlling a pressure in the exhaust branch passage upstream of the filter to continuously make the pressure equal to or greater than the pressure in the common exhaust passage, and the valve functions as pressure increasing means for increasing a pressure of the exhaust branch passage downstream of the filter to a pressure level which is sufficiently high for the exhaust gas to flow back from the exhaust branch passage downstream of the filter to the exhaust branch passage upstream of the filter.

Also, note that the structure of the fourth embodiment except for the above-described structure of the fourth embodiment is the same as the first embodiment.

While the invention has been described by reference to specific embodiments chosen for purpose of illustration, it should be apparent that numerous modifications can be made thereto by those skilled in the art without departing from the basic concept and scope of the invention.

We claim:

1. An exhaust gas purification device of a compression-ignition combustion engine, said device comprising:

exhaust branch passages each being connected to a corresponding cylinder of the engine at one end thereof and connected to a common exhaust passage at the other end thereof;

a filter arranged in at least one of the exhaust branch passages to trap particulates in the exhaust gas discharged from the engine;

pressure control means for controlling a pressure in the exhaust branch passage upstream of the filter to continuously make the pressure equal to or greater than a pressure in the exhaust branch passage downstream of the filter; and pressure increasing means for increasing a pressure of the exhaust branch passage downstream of the filter to a pressure level that is sufficiently high for the exhaust gas to flow back from the exhaust branch passage downstream of the filter to the exhaust branch passage upstream of the filter.

2. An exhaust gas purification device according to claim 1, wherein said pressure control means comprises a communication passage which communicates the exhaust branch passage upstream of the filter with the other exhaust branch passages.

3. An exhaust gas purification device according to claim 1, wherein said pressure increasing means comprises a valve arranged in the common exhaust passage.

4. An exhaust gas purification device according to claim 3, wherein the valve is normally open and is closed when the pressure in the exhaust branch passage downstream of the filter is to be greater than the pressure in the exhaust branch passage upstream of the filter.

5. An exhaust gas purification device according to claim 4, wherein said pressure control means comprises a communication passage which communicates the exhaust branch passage upstream of the filter with another exhaust branch passage, and said pressure increasing means comprises a valve arranged in the communication passage.

6. An exhaust gas purification device according to claim 1, the valve is normally open and is closed when the pressure in the exhaust branch passage downstream of the filter is to be greater than the pressure in the exhaust branch passage upstream of the filter.

7. An exhaust gas purification device according to claim 1, wherein said pressure increasing means comprises a communication passage which communicates the exhaust branch passage downstream of the filter with another exhaust branch passage, and a valve arranged in the communication passage.

8. An exhaust gas purification device according to claim 7, wherein the valve is normally closed and is opened when the pressure in the exhaust branch passage downstream of the filter is to be greater than the pressure in the exhaust branch passage upstream of the filter.

9. An exhaust gas purification device according to claim 1, wherein a turbine wheel of a turbo-charger is arranged in the common exhaust passage.

10. An exhaust gas purification device according to claim 1, wherein a portion of the exhaust branch passage extends generally vertically, and the filter is arranged in the vertically extending portion.

11. An exhaust gas purification device according to claim 1, comprising a filter arranged in each of the exhaust branch passages to trap particulates in the exhaust gas discharged from the engine.

12. An exhaust gas purification device of a compression-ignition combustion engine, the device comprising:

exhaust branch passages each being connected to a corresponding cylinder of the engine at one end thereof and being connected to a common exhaust passage at the other end thereof;

a filter arranged in at least one of the exhaust branch passages to trap particulate in the exhaust gas discharged from the engine; and pressure control means for controlling a pressure in the exhaust branch passage upstream of the filter to continuously make the pressure equal to or greater than a pressure in the exhaust branch passage downstream of the filter;

wherein the exhaust branch passage includes a downstream portion downstream of the filter and an upstream portion upstream of the filter, the downstream portion has a length that is longer than a length of the upstream portion to continuously make the pressure in the upstream portion equal to or greater than a pressure in the downstream portion.

13. An exhaust gas purification device according to claim 12, comprising a filter arranged in each of the exhaust branch passages to trap particulate in the exhaust gas discharged from the engine.

14. An exhaust gas purification device of a compression-ignition combustion engine, the device comprising:

exhaust branch passages each being connected to a corresponding cylinder of the engine at one end thereof and connected to a common exhaust passage at the other end thereof;

a filter disposed in at least one of the exhaust branch passages to trap particulate in the exhaust gas discharged from the engine;

a pressure controller that controls a pressure in the exhaust branch passages upstream of the filter to continuously make the pressure equal to or greater than a pressure in the exhaust branch passages downstream of the filter; and a pressure increaser that increases a pressure of the exhaust branch passage downstream of the filter to a pressure level that is sufficiently high for the exhaust gas to flow back from the exhaust branch passage downstream of the filter to the exhaust branch passage upstream of the filter.

15. An exhaust gas purification device according to claim 14, wherein the pressure controller comprises a communication passage which communicates the exhaust branch passages upstream of the filter with each other, and the pressure increaser comprises a valve disposed in the communication passage.

16. An exhaust gas purification device according to claim 15, wherein the valve is closed when the pressure in the exhaust branch passage downstream of the filter is to be greater than the pressure in the exhaust branch passage upstream of the filter.

17. An exhaust gas purification device according to claim 14, wherein the pressure increaser comprises a communication passage which communicates the exhaust branch passage downstream of the filter with another exhaust branch passage, and a valve arranged in the communication passage.

18. An exhaust gas purification device according to claim 17, wherein the valve is opened when the pressure in the exhaust branch passage downstream of the filter is to be greater than the pressure in the exhaust branch passage upstream of the filter.

* * * * *